US010738623B2

(12) United States Patent
Puram et al.

(10) Patent No.: US 10,738,623 B2
(45) Date of Patent: Aug. 11, 2020

(54) FREQUENCY TUNING OPTION FOR TURBINE BLADES

(71) Applicant: Rolls-Royce Corporation, Indianapolis, IN (US)

(72) Inventors: Gayathri Puram, Bengaluru (IN); Sivaram Surya Sanyasi Adavikolanu, Bengaluru (IN)

(73) Assignee: ROLLS-ROYCE CORPORATION, Indianapolis, IN (US)

( * ) Notice: Subject to any disclaimer, the term of this patent is extended or adjusted under 35 U.S.C. 154(b) by 216 days.

(21) Appl. No.: 15/841,643

(22) Filed: Dec. 14, 2017

(65) Prior Publication Data

US 2019/0032497 A1 Jan. 31, 2019

(30) Foreign Application Priority Data

Jul. 31, 2017 (IN) ..... 201711027126

(51) Int. Cl.
*F01D 5/22* (2006.01)

(52) U.S. Cl.
CPC ..... *F01D 5/225* (2013.01); *F01D 5/22* (2013.01); *F05D 2250/75* (2013.01); *F05D 2260/96* (2013.01)

(58) Field of Classification Search
CPC ... F01D 5/00; F01D 5/22; F01D 5/225; F01D 5/26; F01D 5/10; F01D 25/04; F05D 2250/183
See application file for complete search history.

(56) References Cited

U.S. PATENT DOCUMENTS 5,201,850 A 4/1993 Lenhardt et al.
5,211,540 A 5/1993 Evans

*Primary Examiner* — Richard A Edgar
*Assistant Examiner* — Maranatha Boardman
(74) *Attorney, Agent, or Firm* — Brinks Gilson & Lione

(57) ABSTRACT

A system, method, and apparatus for tuning an operating frequency of turbines blades may be provided. Multiple blades having tip shrouds may be provided. The blades may extend radially outward from an axis of rotation of the blades. A tip shroud of each blade may be located at a radial end of the blades. The tip shrouds may have side faces that interlock with faces of adjacent tip shrouds. In addition, some tip shrouds may have one or more gaps between some side faces of consecutive tip shrouds.

10 Claims, 6 Drawing Sheets

FREQUENCY TUNING OPTION FOR TURBINE BLADES

CROSS-REFERENCE TO RELATED APPLICATION

This application claims the benefit of Indian Provisional Application number 201711027126, entitled "FREQUENCY TUNING OPTION FOR TURBINE BLADES," filed Jul. 31, 2017, the entire contents of which are hereby incorporated by reference.

TECHNICAL FIELD

This disclosure relates to gas turbine engines and, in particular, to turbine blades in gas turbine engines.

BACKGROUND

Gas turbine engines include turbine blades. Operating a gas turbine engine may subject various components of the gas turbine engine, such as the turbine blades, to mechanical stresses and vibrations.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

By way of an introductory example, an apparatus may be provided that includes blades having tip shrouds. The blades may extend radially outward from an axis of rotation of the blades. The tip shroud of each blade may be located at a radial end of the blades. The tip shrouds may have side faces that interlock with faces of consecutive tip shrouds. A subset of the tip shrouds may have a gap between some side faces of consecutive tip shrouds.

One interesting feature of the apparatus, systems, and methods described below may be that the interlocking nature of the tip shrouds may assist in changing the blade's frequencies and avoiding self-reasonance. Alternatively or in addition, an interesting feature of the apparatus, systems, and methods described below may be a reduction in vibration of the blades. The reduction in vibration of the blades may reduce a likelihood of possible damage to the gas turbine engine as well as reduce unnecessary losses in energy. Alternatively or in addition, an interesting feature of the apparatus, systems, and methods described below may be an improved flexibility of the blades. Alternatively or in addition, an interesting feature of the apparatus, systems, and methods described below may be that the individual blades or blade elements of the apparatus, systems, and methods described below may be less costly to repair or replace when compared to other apparatus, systems, and methods.

Figure 1:
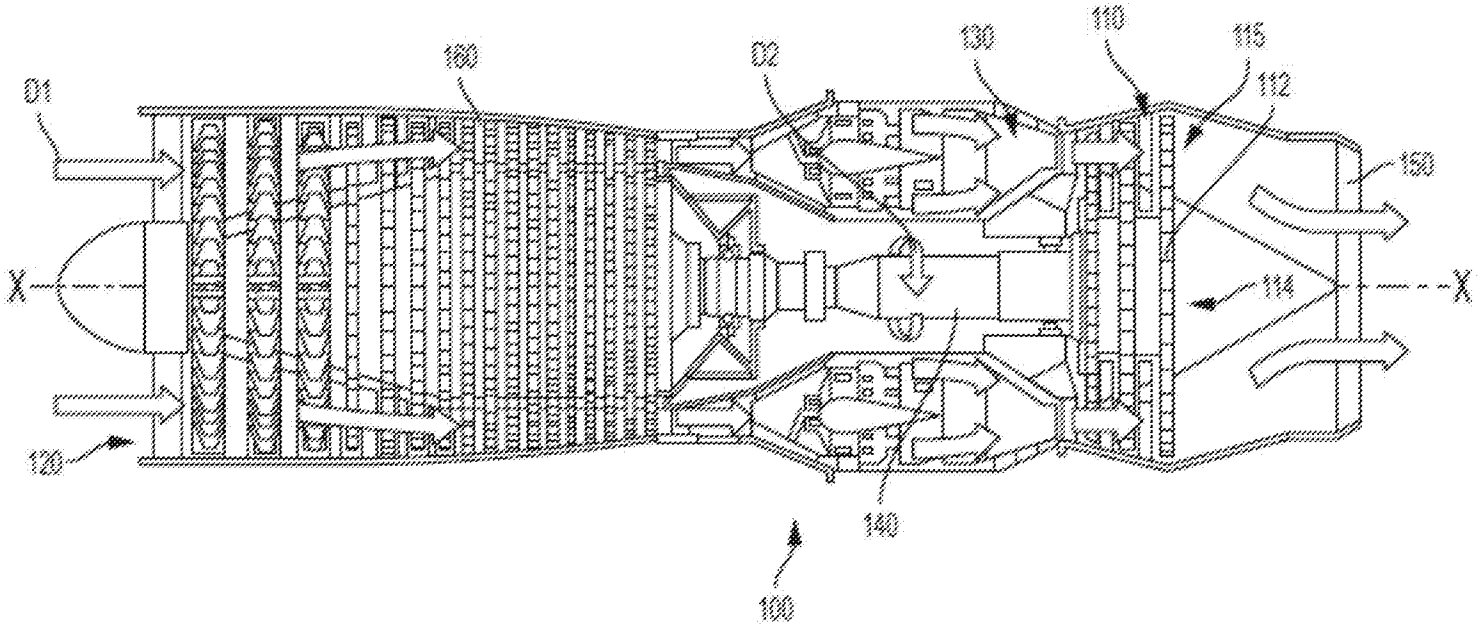
FIG. 1 illustrates a cross-sectional view of an example of a gas turbine engine including a turbine section.

FIG. 1 illustrates a cross-sectional view of a gas turbine engine 100 for propulsion of, for example, an aircraft. Alternatively or in addition, the gas turbine engine 100 may be used to drive a propeller in aquatic applications, or to drive a generator in energy applications. The gas turbine engine 100 may include an intake section 120, a compressor section 160, a combustion section 130, a turbine section 110, and an exhaust section 150. During operation of the gas turbine engine 100, fluid received from the intake section 120, such as air, travels along the axial direction D1 and may be compressed within the compressor section 160. The compressed fluid may then be mixed with fuel and the mixture may be burned in the combustion section 130. The combustion section 130 may include any suitable fuel injection and combustion mechanisms. The hot, high pressure fluid may then pass through the turbine section 110 to extract energy from the fluid and cause a turbine shaft of a turbine 114 in the turbine section 110 to rotate, which in turn drives the compressor section 160. Discharge fluid may exit the exhaust section 150.

As noted above, the hot, high pressure fluid may pass through the turbine section 110 during operation of the gas turbine engine 100. As the fluid flows through the turbine section 110, the fluid may pass through a blade assembly 115, specifically between adjacent blades 112 included in the blade assembly 115, of the turbine 114 causing the turbine 114 to rotate. The rotating turbine 114 may turn a shaft 140 in a rotational direction D2, for example. The blades 112 may rotate around an axis of rotation, which may correspond to a centerline X of the turbine 114 in some examples. The blade assembly 115 may be, for example, the arrangement of the blades 112 in the turbine section 110 of the gas turbine engine 100.

Figure 2:
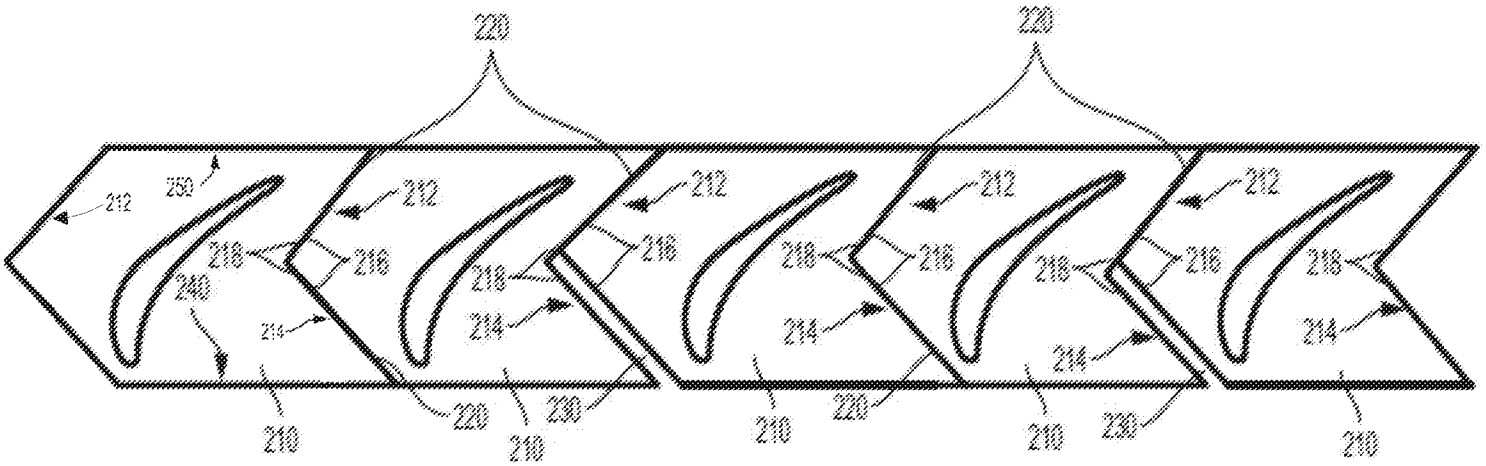
FIG. 2 illustrates a bottom view of an example of several tip shrouds with V-shaped sides and two gaps, each gap between one of two pairs of tip shrouds.

Referring to FIG. 2, the blades 112 may each have a tip shroud 210. Each tip shroud 210 may be situated on an end of a corresponding one of the blades 112 that is radially furthest from the centerline X or axis of rotation if the blades 112 and tip shrouds are installed. During operation of the gas turbine engine 100, the tip shrouds 210 may interlock at interlocking interfaces 220, thus transfers the load across the adjacent blades. Alternatively or in addition, gaps 230 may exist between consecutive tip shrouds 210. The tip shrouds 210 used in the turbine section 110 of the gas turbine engine 100 may be interlocked in such a way as to form an annular structure around the centerline X.

FIG. 2 illustrates a bottom view of multiple tip shrouds 210. The number of tip shrouds 210 in the turbine section 110 is not necessarily limited to five, as shown in FIG. 2; rather, FIG. 2 is merely an example of a subset of the tip shrouds 210 installed in the turbine section 110. The tip shrouds 210 may have a suction side 212 and a pressure side 214. The suction sides 212 may include suction side faces 216, and the pressure sides 214 may include pressure side faces 218. FIG. 2 shows an example of five of the tip shrouds 210 in a sequence. In addition, the tip shrouds 210 may include a leading edge side 240 and a trailing edge side 250. The tip shrouds 210 may interlock at interlocking interfaces 220. The interlocking interfaces 220 may occur at a location where one or more of the suction side faces 216 of one of the tip shrouds 210 engages with one or more of the pressure side faces 218 of an adjacent one of the tip shrouds 210.

The tip shroud 210 may be a component attached to or integral with a respective one of the blades 112 that limits or prevents fluid flow over a tip of the blade 112 so that the fluid instead flows around the blades 112. In some examples, the tip shroud 210 may be a mechanical damping device, which may include a seal rail, configured to reduce vibration of the blades 112 by acting as a frictional dampener. The seal rail may be a protrusion from the tip shroud 210 that prevents hot, pressurized fluid from travelling over the radially outward end of the blade 112. Examples of the tip shroud 210 may include one or more surfaces integrally or removably attached to the respective one of the blades 112. In some examples, the tip shroud 210 includes the leading edge side 240 and the trailing edge side 250. The trailing edgeside 250 may be the side of the tip shroud 210 that is positioned downstream with respect to the hot fluid that flows through the turbine section 110 during operation of the gas turbine engine 100. The leading edge side 240 may be the side of the tip shroud 210 that is positioned upstream with respect to the hot fluid that flows through the turbine section 110 during operation of the gas turbine engine 100.

The suction side 212 may be the side of the tip shroud 210 that is in a direction of rotation of the tip shroud 210 during operation of the gas turbine engine 100. In contrast, the pressure side 214 may be the side of the tip shroud 210 that is opposite of the direction of rotation of the tip shround 210 during operation of the gas turbine engine 100.

As mentioned above, the suction side 212 may comprise the suction side faces 216. Each of the suction side faces 216 may be flat, jagged, curved, any combination of shapes, or any other suitably shaped surface. The suction side faces 216 on any one of the tip shrouds 210 may have a common shape. For example, in FIG. 2, the suction side faces 216 are all flat. The suction side faces 216 may be similarly shaped on any one of the tip shrouds 210 or similarly shaped in comparison to any other of the tip shrouds 210. Alternatively or in addition, the suction side faces 216 of any one of the tip shrouds 210 together form a shape that may be different from or similar to a shape formed by the suction side faces 216 of any other one of the tip shrouds 210. Alternatively or in addition, the suction side faces 216 of any one of the tip shrouds 210 together form a shape that may be different from or similar to a shape formed by the pressure side faces 218 of any other one of the tip shrouds 210. The suction side faces 216 of the suction side 212 may be arranged to form a V-shape, a Z-shape, or any desired shape.

As mentioned above, the pressure side 214 may comprise the pressure side faces 218. Each of the pressure side faces 218 may be flat, jagged, curved, any combination of shapes, or any suitably shaped surface. The pressure side faces 218 on any one of the tip shrouds 210 may have a common shape. For example, in FIG. 2, the pressure side faces 218 are all flat. The pressure side faces 218 may be similarly shaped on any one of the tip shrouds 210 or similarly shaped in comparison to any other of the tip shrouds 210. Alternatively or in addition, the pressure side faces 218 of any one of the tip shrouds 210 together form a shape that may be different from or similar to a shape formed by the pressure side faces 218 of any other one of the tip shrouds 210. Alternatively or in addition, the pressure side faces 218 of any one of the tip shrouds 210 together form a shape that may be different from or similar to a shape formed by the suction side faces 216 of any other of the tip shrouds 210. The pressure side faces 218 of the pressure side 214 may be arranged to form a V-shape, a Z-shape, or any desired shape.

Each of the interlocking interfaces 220 may be any face of any of the tip shrouds 210 that, during operation of the gas turbine engine 100, contacts a face of any of the other of the tip shrouds 210. In some examples, the faces of the tip shrouds 210 that form the interlocking interfaces 220 may be in contact during non-operation of the gas turbine engine 100. Alternatively, in some examples, the faces of the tip shrouds 210 that form the interlocking interfaces 220 may not be in contact during non-operation of the gas turbine engine 100.

The interlocking interfaces 220 are not bonds or welds between tip shrouds 210, but, rather, during operation of the gas turbine engine 100 may be abutting faces of adjacent tip shrouds 210. During rotation of the blades 112, for example during operation of the gas turbine engine 100, adjacent tip shrouds may be loaded against each other. For example, an interlocking surface may be any of the suction side faces 216 of a first one of the tip shrouds 210 that contacts any of the pressure side faces 218 of a second one of the tip shrouds 210 during operation of the gas turbine engine 100. The interlocking interfaces 220 may be along the leading edge side 240. Alternatively or in addition, the interlocking interfaces 220 may be along the trailing edge side 250. The interlocking interfaces 220 may partially or completely prevent hot fluid from travelling around the tip shroud 210 during operation of the gas turbine engine 100.

Figure 4:
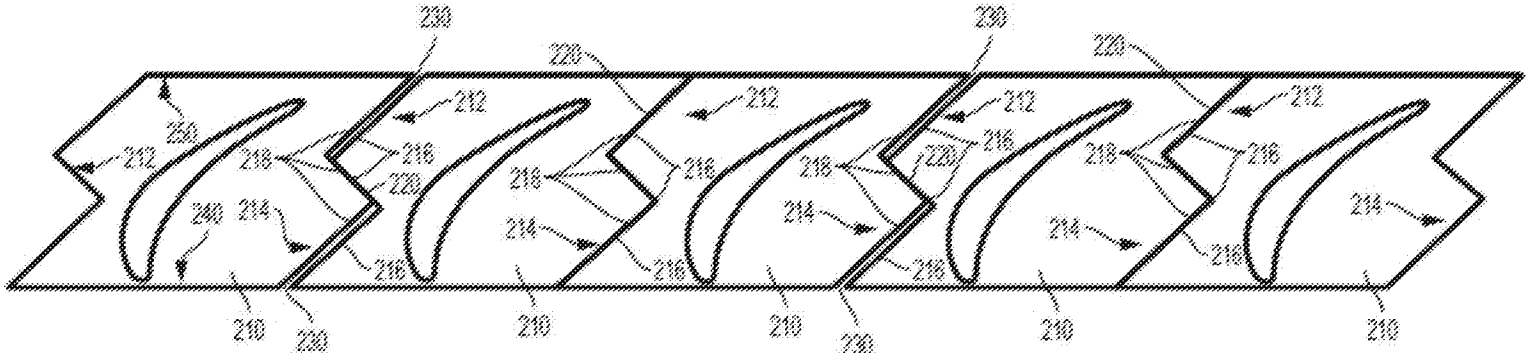
FIG. 4 illustrates a bottom view of an example of several tip shrouds with Z-shaped sides and zero gaps between some tip shrouds.
Figure 5:
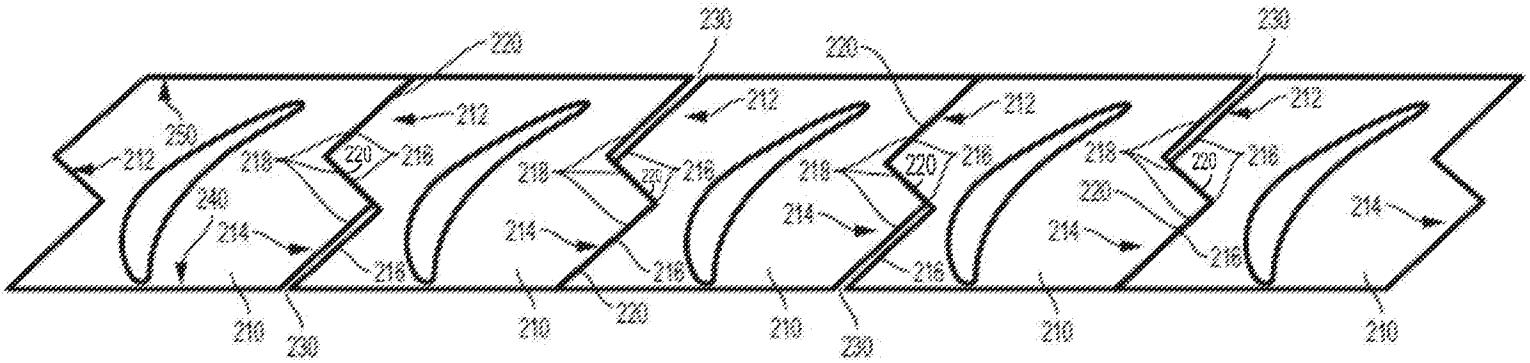
FIG. 5 illustrates a bottom view of another example of several tip shrouds with Z-shaped sides and alternating gap orientations between consecutive tip shrouds.

The pressure side faces 218 of a first subset of the tip shrouds 210 may be shaped to match the suction side faces 216 of a second subset of the tip shrouds 210 such that at least one of the interlocking interfaces 220 formed by the engagement of the suction side faces 216 to the pressure side faces 218 may be continuous lengths. For example, the suction side faces 216 of the tip shrouds 210 as well as the pressure side faces 218 of the tip shrouds 210 may be arranged in a V-shape, thus resulting in the interlocking interfaces 220 that include a portion of the V-shape, as shown in FIG. 2. Alternatively or in addition, the suction side faces 216 of the tip shrouds 210 as well as the pressure side faces 218 of the tip shrouds 210 may be arranged in a Z-shape, thus resulting in interlocking interfaces 220 that include a portion of the Z-shape, as shown in FIGS. 3-5.

The gap 230 may be defined by a distance between one or more of the suction side faces 216 of one tip shroud 210 and one or more of the pressure side faces 218 of another one of the tip shrouds 210. The gap 230 may be present along the leading edge side 240. Alternatively or in addition, the gap 230 may be present along the trailing edge side 250. In some examples, the gap 230 may be a non-constant distance. For example, the gap 230 may expand from the leading edge side 240 toward the trailing edge side 250 of the tip shrouds 210. Alternatively or in addition, in some examples, the gap 230 may expand from the trailing edge side 250 toward the leading edge side 240. The gap 230 may be present between each tip shroud 210 or only some tip shrouds 210. Because the gap 230 may be defined by one or more of the suction side faces 216 of one tip shroud 210 and one or more of the pressure side faces 218 of another tip shroud 210, the shape of the gap 230 may depend on the shape of the individual suction side faces 216, individual pressure side faces 218, the arrangement of the suction side faces 216 or pressure side faces 218 on the respective suction side 212 or pressure side 214, or any combination thereof. In some examples, the entire suction side 212 of one tip shroud 210 may completely interlock with the pressure side 214 of another tip shroud 210, thus the interlocking interface 220 may include the entirety of the suction side 212 of one tip shroud 210 and the pressure side 214 of another tip shroud 210 resulting in no gap 230 being present, or put another way, the gap 230 would have a width of zero.

In some examples, the gap 230 may be present at regular intervals. For example, a series of several tip shrouds 210 is shown in FIG. 2. In FIG. 2, the gap 230 is present between two of the five tip shrouds 210. In FIG. 2, when the gap 230 is present between a pair of tip shrouds 210, the gap 230 is not present between the consecutive pair of tip shrouds 210. FIG. 2 is only one example of the gap being present at regular intervals. The gap 230 could be present between every second, third, fourth, etc. tip shrouds 210. Alternatively or in addition, groups, but not all, of tip shrouds 210 may have gaps 230 present at regular intervals. Alternatively, or in addition, the gap 230 may be present at one regular interval along the leading edge side 240 while at a second regular interval along the trailing edge side 250. Alternatively, the gap 230 may be present between several pairs of tip shrouds 210, but without any regularity or uniformity. As mentioned above, the gaps 230 may be arranged at regular intervals, irregular intervals, or without any pattern between tip shrouds 210. As described in more detail below, adding gaps at targeted locations provides an ability to "tune" the vibration frequencies of the turbine blades 112.

Figure 3:
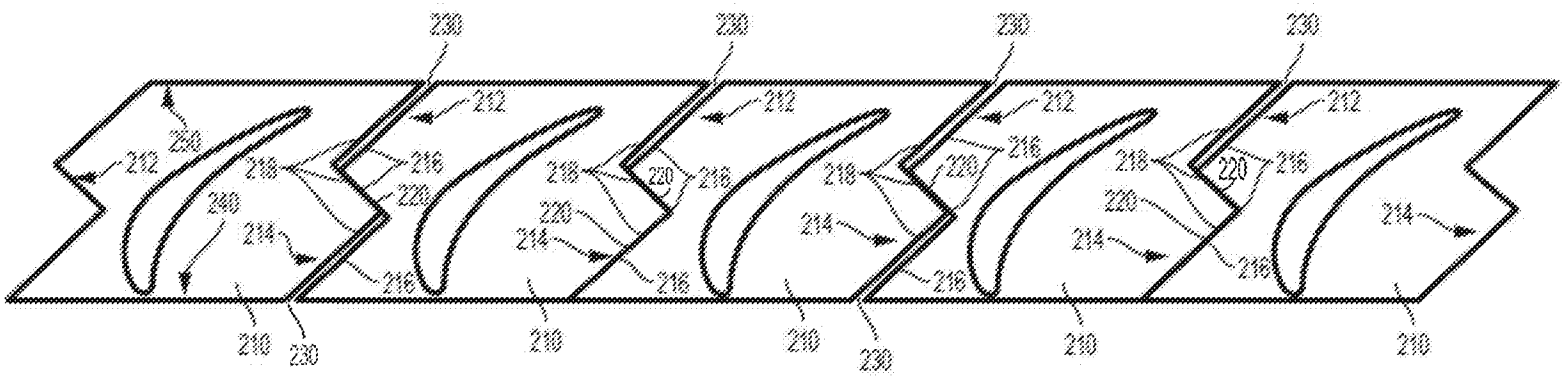
FIG. 3 illustrates a bottom view of an example of several tip shrouds with Z-shaped sides and alternating gap orientations between consecutive tip shrouds.

FIG. 3 shows another example of a bottom view of several tip shrouds 210 in series with gaps 230 at regular intervals. FIG. 3 shows Z-shaped suction sides 212 as well as Z-shaped pressure sides 214 of tip shrouds 210. In some examples, the gaps 230 are present at regular intervals along the leading edge side 240, along the trailing edge side 250, or both. In some examples, the gap 230 is present between every tip shroud 210 on at least one of the leading edge side 240 or the trailing edge side 250. Alternatively or in addition, the gap 230 may be at the same or different regular interval on the leading edge side 240 as the gap 230 is on the trailing edge side 250. The example shown in FIG. 3 includes one gap 230 between every pair of tip shrouds 210 on the trailing edge side 250 and wherein if the gap 230 is present on the leading edge side 240 between a pair of tip shrouds 210, the gap 230 is not present on the leading edge side 240 of the following consecutive pair of tip shrouds 210. As mentioned above, the gaps 230 may be arranged at regular intervals, irregular intervals, or without any pattern between tip shrouds 210.

FIG. 4 shows another example of a bottom view of several tip shrouds 210 in series with gaps 230 at regular intervals. FIG. 4 shows Z-shaped suction sides 212 as well as Z-shaped pressure sides 214 of tip shrouds 210. The example shown in FIG. 4 includes two gaps 230 between two tip shrouds 210, followed by interlocking interfaces 220 between the next consecutive pair of tip shrouds 210 on both the leading edge side 240 and the trailing edge side 250. As shown in FIG. 4, one of the two gaps 230 present between a pair of tip shrouds 210 is present on the leading edge side 240 and one of the two gaps 230 is present on the trailing edge side 250. As mentioned above, the gaps 230 may be arranged at regular intervals, irregular intervals, or without any pattern between tip shrouds 210.

FIG. 5 shows another example of a bottom view of several tip shrouds 210 in series with gaps 230 at regular intervals. FIG. 5 shows Z-shaped suction sides 212 as well as Z-shaped pressure sides 214 of tip shrouds 210. The example shown in FIG. 5 includes one gap 230 between every pair of tip shrouds 210, wherein if the gap 230 is present on the leading edge side 240 between a pair of tip shrouds 210, the gap 230 is present on the trailing edge side 250 of the following consecutive pair of tip shrouds 210, and vice versa. As mentioned above, the gaps 230 may be arranged at regular intervals, irregular intervals, or without any pattern between tip shrouds 210.

In all examples shown in FIGS. 2-5, the interlocking interface 220 is shown in at least a portion of every pair of tip shrouds 210.

A method for assembling blades is also provided. The method may include assembling the blades 112 and the tip shrouds 210 in such a way that the gaps 230 and the interlocking interfaces 220 are formed. During operation of the gas turbine engine 100, the blades 112 may experience vibrations at various frequencies. Targeted vibration frequencies may be achieved by, for example, specifically arranging the gaps 230 and the interlocking interfaces 220 between tip shrouds 210. Particular arrangements of the gaps 230 and the interlocking interfaces 220 between adjacent tip shrouds 210 may adjust the blades' 112 vibration frequencies to avoid, for example, damage to the gas turbine engine 100 and losses of energy.

Figure 6:
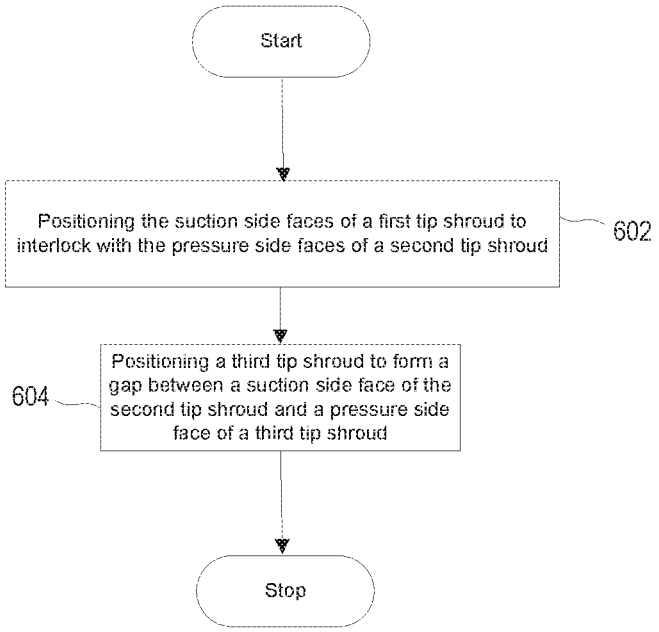
FIG. 6 illustrates a method for assembling blades to form a blade assembly.

FIG. 6 shows an example method of assembling the blades in a blade assembly 115. The method may include positioning (602) a first one of the tip shrouds 210 adjacent to a second one of the tip shrouds 210 so that the suction side faces 216 of the first one of the tip shrouds 210 interlock with the pressure side faces 218 of the second one of the tip shrouds 210. The method may further include positioning a third one of the tip shrouds 210 adjacent to the second one tip shrouds 210 such that the gap 230 is formed (604) between one of the suction side faces 216 of the second one of the tip shrouds 210 and one of the pressure side faces 218 of the third one of the tip shrouds.

Subsequent blades 112 including the tip shroud 210 may be added to the blade assembly 115 by interlocking the pressure side face 218 of the subsequent tip shroud 210 with the suction side face 216 of the previous tip shroud 210, creating the interlocking interface 220. Alternatively or in addition, subsequent blades 112 with the tip shroud 210 may be added to the blade assembly 115 by defining the gap 230 by the pressure side face 218 of the subsequent tip shroud 210 and the suction side face 216 of the previous tip shroud 210. Alternatively or in addition, subsequent blades 112 with tip shrouds 210 may be added to the blade assembly 115 by interlocking the suction side face 216 of the subsequent tip shroud 210 with the pressure side face 218 of the previous tip shroud 210, creating the interlocking interface 220. Alternatively or in addition, subsequent blades 112 with tip shrouds 210 may be added to the blade assembly 115 by defining the gap 230 by the suction side face 216 of the subsequent tip shroud 210 with the pressure side face 218 of the previous tip shroud 210. Alternatively or in addition, subsequent blades 112 may be assembled between already assembled blades 112. Assembly of blades 112 may continue in this fashion until the desired blade assembly 115 is assembled. The desired blade assembly 115 may be completely assembled when the blade frequencies during operation of the blade assembly 115 includes the targeted, desired blade frequencies.

The target arrangments of the gaps 230 and the interlocking interfaces 220 may be, but are not limited to, any of the arrangements described above. For example, target arrangement of the gap 230 may be present along the leading edge side 240. Alternatively or in addition, target arrangement of the gap 230 may be present along the trailing edge side 250. Alternatively or in addition, the interlocking interfaces 220 may be along the leading edge side 240. Alternatively or in addition, the interlocking interfaces 220 may be along the trailing edge side 250. For example, the gaps 230 and interlocking interfaces 220 may be present or not present between any particular pair of the tip shrouds 210. Alternatively or in addition, the target arrangement of the gaps 230 may be patterned irregularly or regularly apart from other gaps 230. Alternatively or in addition, target arrangement of the interlocking interfaces 220 may be patterned irregularly or regularly apart from other interlocking interfaces 220. For example, the gap 230 may occur regularly, such as, but not limited to, between every third pair of tip shrouds. Alternatively or in addition, the gap 230 may occur regularly, such as, but not limited to, at the leading edge side 240 of a first pair of the tip shrouds 210, at the trailing edge side 250 of a second pair of the tip shrouds 210, and at the leading edge side 240 of a third pair of the tip shrouds 210 and so on. Alternatively or in addition, the gap 230 may occur regularly, such as, but not limited to, two gaps 230 between a first pair of tip shrouds 210 followed consecutively by no gaps between the pairs of tip shrouds 210 adjacent to the first pair of tip shrouds 210. These are only some of the regular patterns that could be utilized to achieve the desired blade frequencies of the blades 112 and is not intended as an exhaustive list. Alternatively, the gaps 230 may be arranged without any pattern or in an irregular pattern.

To clarify the use of and to hereby provide notice to the public, the phrases "at least one of <A>, <B>, . . . and <N>" or "at least one of <A>, <B>, <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed.

While various embodiments have been described, it will be apparent to those of ordinary skill in the art that many more embodiments and implementations are possible. Accordingly, the embodiments described herein are examples, not the only possible embodiments and implementations.

The subject-matter of the disclosure may also relate, among others, to the following aspects:

1. An apparatus comprising:
   a plurality of blades, each of the blades comprising a tip shroud, the tip shroud comprising a suction side and a pressure side, the suction side comprising a plurality of suction side faces, wherein the suction side faces comprise a first suction side face and a second suction side face, the pressure side comprising a plurality of pressure side faces, wherein the pressure side faces comprise a first pressure side face and a second pressure side face,
   wherein the tip shrouds comprise a first tip shroud, a second tip shroud, and a third tip shroud,
   the first pressure side face of the first tip shroud and the first suction side face of the second tip shroud form an interlocking interface,
   a gap is defined by the first pressure side face of the second tip shroud and the first suction side face of the third tip shroud, and
   wherein both the gap and the interlocking interface are situated at a leading edge side of the tip shrouds or both the gap and the interlocking interface are situated at a trailing edge side of the tip shrouds.
2. The apparatus of aspect 1, wherein the suction side is Z-shaped and wherein the pressure side is Z-shaped.
3. The apparatus of aspect 1-2, wherein the suction side is V-shaped and wherein the pressure side is V-shaped.
4. The apparatus of aspect 1-3, wherein a width of the gap varies along the first pressure side face of the second tip shroud and the first suction side face of the third tip shroud.
5. The apparatus of aspect 1-4, wherein the gap is a first gap between the second tip shroud and the third tip shroud, and a second gap defined by the second pressure side face of the second tip shroud and the second suction side face of the third tip shroud.
6. The apparatus of aspect 1-5, wherein the gap is a first gap of a plurality of gaps, the gaps further comprising a second gap and a third gap, the second gap defined by the second pressure side face of the second tip shroud and the second suction side face of the third tip shroud, and the third gap defined by the second pressure side face of the first tip shroud and the second suction side face of the second tip shroud.
7. The apparatus of aspect 1, wherein the gap and the interlocking interface are situated along the leading edge side of the tip shrouds.
8. The apparatus of aspect 1, wherein the gap and the interlocking interface are situated along the trailing edge side of the tip shrouds.
9. A system comprising:
   a turbine comprising a shaft and a plurality of blades, the plurality of blades extending radially from the shaft, wherein each of the plurality of blades comprises a respective one of a plurality of tip shrouds, each tip shroud situated at a radial end of a respective one of the blades, each tip shroud comprising a suction side and a pressure side, the suction side comprising a plurality of suction side faces, wherein the suction side faces comprise a first suction side face and a second suction side face, and the pressure side comprising a plurality of pressure side faces, wherein the pressure side faces comprise a first pressure side face and a second pressure side face,
   wherein the tip shrouds comprise a first tip shroud, a second tip shroud, and a third tip shroud,
   the first pressure side face of the first tip shroud and the first suction side face of the second tip shroud are adjacent at an interlocking interface,
   a gap is defined by the first pressure side face of the second tip shroud and the first suction side face of the third tip shroud, and
   both the gap and the interlocking interface are situated along a leading edge side of the tip shrouds or both the gap and the interlocking interface are situated along a trailing edge side of the tip shrouds.
10. The system of aspect 9, wherein the suction side is Z-shaped and wherein the pressure side is Z-shaped.
11. The system of aspect 10, wherein the gap is a first gap and a second gap is defined by the second pressure side face of the first tip shroud and the second suction side face of the second tip shroud.
12. The system of aspect 9-11, wherein the tip shrouds further comprise a fourth tip shroud, the interlocking interface is a first interlocking interface of a plurality of interlocking interfaces, the interlocking interfaces comprise a second interlocking interface, and the first pressure side face of the third tip shroud and the first suction side face of the fourth tip shroud form the second interlocking interface.

13. The system of aspect 12, the gap is a first gap and a second gap is defined by the second pressure side face of the third tip shroud and the second suction side face of the fourth tip shroud.

14. The system of aspect 13, wherein the suction side is Z-shaped and wherein the pressure side is Z-shaped.

15. A method comprising:

assembling a plurality of blades into a blade assembly, each of the blades comprising a tip shroud, the tip shroud of each of the blades comprising a suction side and a pressure side, the suction side comprising a plurality of suction side faces including a first suction side face and a second suction side face, the pressure side comprising a plurality of pressure side faces including a first pressure side face and a second pressure side face, wherein assembling the blades comprises:

positioning a first tip shroud adjacent to a second tip shroud so that the first pressure side face of the first the tip shroud abuts the first suction side face of the second tip shroud to form an interlocking interface at one of a leading edge side of the tip shrouds or a trailing edge side of the tip shrouds;

positioning a third tip shroud adjacent to the second tip shroud to form a gap between the first pressure side face of the second tip shroud and the first suction side face of the third tip shroud, the gap situated at the same of the leading edge side and the trailing edge side as the interlocking interface is situated.

16. The method of aspect 15, wherein the gap is a first gap of a plurality of gaps, the gaps comprising a second gap, the tip shrouds further comprising a fourth tip shroud and a fifth tip shroud, the method further comprising forming the second gap between the first pressure side face of the fourth tip shroud and the first suction side face of the fifth tip shroud.

17. The method of aspect 16 wherein assembling the blades comprises arranging the gaps in a target arrangement.

18. The method of aspect 17, wherein the target arrangement of the gaps is an irregular pattern.

19. The method of aspect 17, wherein the target arrangement of the gaps is a regular pattern.

20. The method of aspect 16-19 further comprising locating the first gap on the trailing edge side of the tip shrouds and locating the second gap on the leading edge side of the tip shrouds.

What is claimed is:

1. An apparatus comprising:

a plurality of blades, each of the blades comprising a tip shroud, the tip shroud comprising a suction side and a pressure side, the suction side comprising a plurality of suction side faces, wherein the suction side faces comprise a first suction side face and a second suction side face, the pressure side comprising a plurality of pressure side faces, wherein the pressure side faces comprise a first pressure side face and a second pressure side face, wherein the tip shrouds comprise a first tip shroud, a second tip shroud, and a third tip shroud, the first pressure side face of the first tip shroud and the first suction side face of the second tip shroud form a first interlocking interface, the first pressure side face of the second tip shroud and the first suction side face of the third tip shroud form a second interlocking interface, a first gap is defined by the first pressure side face of the second tip shroud and the first suction side face of the third tip shroud, a second gap is defined by the second pressure side face of the first tip shroud and the second suction side face of the second tip shroud, wherein both the first gap and the first interlocking interface are situated at a leading edge side of the tip shrouds and/or both the second gap and the second interlocking interface are situated at a trailing edge side of the tip shrouds.

2. The apparatus of claim 1, wherein the suction side is Z-shaped and the pressure size is Z-shaped.

3. The apparatus of claim 1, wherein a width of the first gap varies along the first pressure side face of the second tip shroud and the first suction side face of the third tip shroud.

4. A system comprising:

a turbine comprising a shaft and a plurality of blades, the plurality of blades extending radially from the shaft, wherein each of the blades comprises a respective one of a plurality of tip shrouds, each tip shroud situated at a radial end of a respective one of the blades, each tip shroud comprising a suction side being Z-shaped and a pressure side being Z-shaped, the suction side comprising a plurality of suction side faces, wherein the suction side faces comprise a first suction side face and a second suction side face, and the pressure side comprising a plurality of pressure side faces wherein the pressure side faces comprise a first pressure side face and a second pressure side face, wherein the tip shrouds comprise a first tip shroud, a second tip shroud, and a third tip shroud, the first pressure side face of the first tip shroud and the first suction side face of the second tip shroud are adjacent at an interlocking interface, a gap is defined by the first pressure side face of the second tip shroud and the first suction side face of the third tip shroud, both the gap and the interlocking interface are situated along a leading edge side of the tip shrouds or both the gap and the interlocking interface are situated along a trailing edge side of the tip shrouds, and wherein the gap is a first gap and a second gap is defined by the second pressure side face of the first tip shroud and the second suction side face of the second tip shroud.

5. The system of claim 4, wherein the tip shrouds further comprise a fourth tip shroud, the interlocking interface is a first interlocking interface of a plurality of interlocking interfaces, the interlocking interfaces comprise a second interlocking interface, and the first pressure side face of the third tip shroud and the first suction side face of the fourth tip shroud form the second interlocking interface.

6. The system of claim 5, wherein a third gap si defined by the second pressure side face of the third tip shroud and the second suction side face of the fourth tip shroud.

7. A method comprising:

assembling a plurality of blades into a blade assembly, each of the blades comprising a tip shroud, the tip shroud of each of the blades comprising a suction side and a pressure side, both of the suction side and the pressure side of each tip shroud being Z-shaped, the suction side comprising a plurality of suction side faces including a first suction side face and a second suction side face, the pressure side comprising a plurality of pressure side faces including a first pressure side face and a second pressure side face, wherein assembling the blades comprises:

positioning a first tip shroud adjacent to a second tip shroud so that the first pressure side face of the first the tip shroud abuts the first suction side face of the second tip shroud to form an interlocking interface at one of a leading edge side of the tip shrouds or a trailing edge side of the tip shrouds; and positioning a third tip shroud adjacent to the second tip shroud to form a gap between the first pressure side face of the second tip shroud and the first suction side face of the third tip shroud, the gap situated at the same of the leading edge side or the trailing edge side as the interlocking interface is situated, wherein the gap is a first gap of a plurality of gaps, and a second gap is defined by the second pressure side face of the first tip shroud and the second suction side face of the second tip shroud.

8. The method of claim 7, wherein the tip shrouds further comprise a fourth tip shroud and a fifth tip shroud, the method further comprising forming a third gap between the first pressure side face of the fourth tip shroud and the first suction side face of the fifth tip shroud.

9. The method of claim 8, wherein assembling the blades comprises arranging the gaps in a target arrangement.

10. The method of claim 9, wherein the target arrangement of the gaps is a regular pattern.

* * * * *